United States Patent [19]

Kurrasch

[11] Patent Number: 4,650,143

[45] Date of Patent: Mar. 17, 1987

[54] ADJUSTABLE SUPPORT

[75] Inventor: Andrew J. Kurrasch, Saugatuck, Mich.

[73] Assignee: Herman Miller, Inc., Zeeland, Mich.

[21] Appl. No.: 727,278

[22] Filed: Apr. 25, 1985

[51] Int. Cl.[4] ..... F16M 11/24

[52] U.S. Cl. ..... 248/188.4; 108/144; 248/412

[58] Field of Search ..... 248/188.4, 188.1, 188.2, 248/188, 188.5, 412, 413; 108/144

[56] References Cited

U.S. PATENT DOCUMENTS

| | | | |
|---|---|---|---|
| 275,413 | 4/1883 | Rich | 248/405 |
| 474,750 | 5/1892 | Little et al. | 248/188.4 |
| 1,342,951 | 6/1920 | Gagne | 248/188 X |
| 1,451,999 | 4/1923 | Perry | 248/188.4 |
| 1,970,624 | 8/1934 | Recker | 248/412 |
| 2,649,345 | 8/1953 | Hubbard | 108/144 |
| 3,063,765 | 11/1962 | Huff | 311/114 |
| 4,156,391 | 5/1979 | Ubezio | 108/144 X |
| 4,195,578 | 4/1980 | Benoit et al. | 248/412 X |
| 4,239,169 | 12/1980 | DeSantis | 248/412 |
| 4,492,354 | 1/1985 | Rice | 248/188 X |
| 4,515,087 | 5/1985 | Kurrasch | 108/144 X |
| 4,526,334 | 2/1985 | Rantakari | 248/412 X |

*Primary Examiner*—Ramon O. Ramirez

*Attorney, Agent, or Firm*—Varnum, Riddering, Schmidt & Howlett

[57] ABSTRACT

An adjustable support (10) for a tabletop (12) includes a base (14), a leg tube (16) rotatably mounted to the base (14), an adjustment tube (18) connected to the leg tube (16) and a spider (20) mounted to and between the adjustment tube (18) and the tabletop (12). A top cap (42) fixedly mounted to the leg tube (16) threadably engages the inside upper wall (56) of the adjustment tube (16) and is rigidly attached to a tension rod (48) secured to and between the base (14) and the top cap (42). In this manner, rotation of the leg tube (16) adjusts the height of the leg tube (16) relative to the adjustment tube (18) to adjust the tabletop (12) to the height desired relative to the floor. The support (10) also includes a wedge ring (90) circumscribing the leg tube (16) and threadably engaging the inside lower wall (58) of the adjustment tube (18); an outwardly-projecting key (92) integral with the wedge ring (90); and a split collet (94) engaging on its upper side (102) the wedge ring (90) and at its lower side (104) the spider (20) and adapted to contact radially around the leg tube (16). During assembly of the support (10), the adjustment tube (18) is rotated relative to the leg tube (16) to cause the wedge ring (90) to rotate until the key (92) interferes with a rib (88) of the spider (20) and thereafter cause the wedge ring (90) to thread downwardly relative to the adjustment tube (18) to thereby tighten the collet (94) against the leg tube (16) through forces exerted on the collet (94) by the wedge ring (90) and spider (20). The foregoing assembly step compensates for manufacturing tolerances between the spider and the leg tube and provides some degree of frictional resistance to rotational movement of the leg tube (16) after the same has been set in the desired adjusted position.

10 Claims, 3 Drawing Figures

ADJUSTABLE SUPPORT

FIELD OF THE INVENTION

The invention relates to supports for tabletops and similar articles and in particular to adjustable supports for tabletops.

BACKGROUND OF THE INVENTION

It is often desirable to incorporate an adjustment feature in a floor-engaging support or pedestal for a table, work surface and the like. This feature allows the height of the tabletop to be adjusted relative to the floor and to thereby comfortably accommodate workers of varying stature.

Adjustable features have been employed in prior art supports for various extensible articles. For example, the Recker Pat. No. 1,970,624, issued Aug, 21, 1934, discloses an adjustable support for lighting fixtures, tables and the like comprising a lower tube and an upper rod telescopically positioned within the lower tube. The rod is secured within the tube at the desired position of adjustment relative to the tube through the rotation of a clamping nut which threadably engages the tube and tightens, when screwed firmly onto the tube, a split flange around the periphery of the rod. In addition, the Rich Pat. No. 275,413, issued Apr. 10, 1883, discloses a piano stool having a base, seat and adjustable support positioned therebetween. The support includes a threaded lower rod secured to the base and an upper tube securely attached at its top portion to the underside of the table and threadably engaging at its bottom portion the threads of the lower rod. The stool is adjusted to the height desired by simply rotating the upper tube by exerting rotational force on the seat. Finally, the Perry Pat. No. 1,451,999, issued Apr. 17, 1923, discloses a furniture leveling device secured to the leg of a piece of furniture. The device comprises an interiorly threaded socket rigidly housed within the leg and a leveling member threadably engaging the socket, wherein the latter is set in the adjusted position relative to the former by rotating the leveling member in the appropriate direction. To secure the leveling member in adjusted position, a spring, comprising a flat steel strip, is rigidly secured at one end to the leveling member and adapated to enter at its other end any one of a number of notches in the socket so as to normally hold the leveling member stationary and resist rotation thereof while permitting rotation when sufficient force is supplied thereto to overcome such resistance.

SUMMARY OF THE INVENTION

An adjustable support for a tabletop includes a lower tube, an upper tube threadably engaging the lower tube, a table support nonrotatably mounted to and between the upper tube and the tabletop, and a rigidifying means for adjustably maintaining the lower tube in tight, mating relationship to the table support and for providing frictional resistance to rotational movement of the lower tube relative to the upper tube, whereby the tabletop is vertically adjustable with respect to the lower tube by rotation of the lower tube with respect to the upper tube. Specifically, the rigidifying means comprises a wedge ring threadably connected to the upper tube; a collet engaging at one end the wedge ring and at the other end the table support and adapted to tighten against the lower tube when the upper tube is rotated through forces exerted on the collet by the wedge ring and the table support.

The adjustable support further includes a securing means for nonrotably mounting the upper tube to the table support. The securing means comprises at least one plate secured to and between the upper tube and the table support to prevent rotation of the upper tube and thus loosening of the collet from the leg tube.

In addition, the adjustable support comprises a floor-engaging base on which is rotatably mounted the lower tube; a top cap threadably engaging the upper tube; and a tension rod rigidly securing the top cap to the upper tube and rotatably mounting the lower tube to the base.

In the preferred embodiment, the upper tube, the table support, the at least one plate, the top cap, the tension rod and the base are composed of metal; and the wedge ring and the collet are made of a low-friction plastic to enable the collet to slide smoothly on the surface of the lower tube upon rotation of the lower tube with respect to the upper tube.

BRIEF DESCRIPTION OF THE DRAWINGS

The invention will now be described with reference to the drawings in which.

DESCRIPTION OF THE PREFERRED EMBODIMENTS

Figure 1:
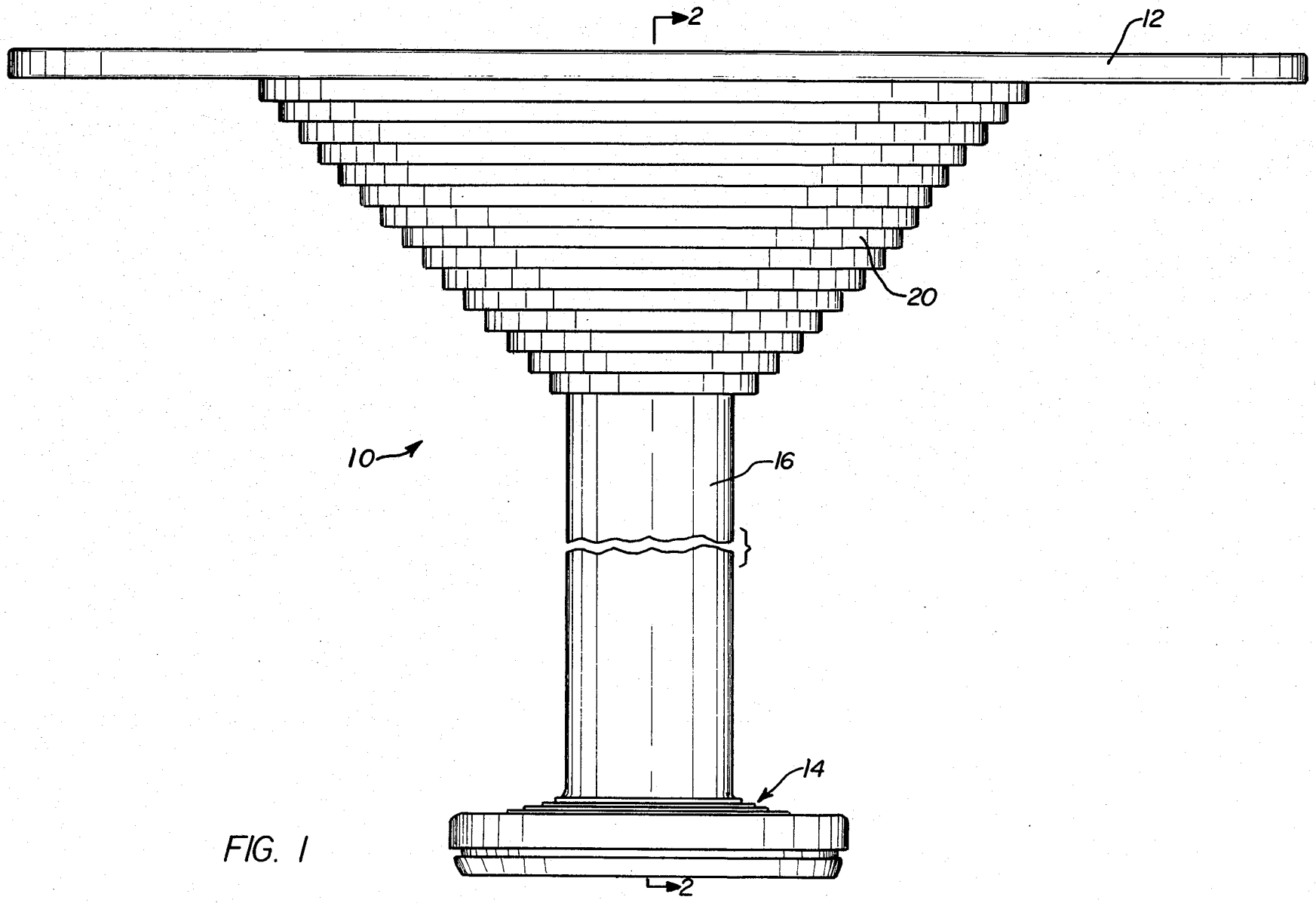
FIG. 1 is a front elevational view of the adjustable support of the invention.
Figures 2, 3:
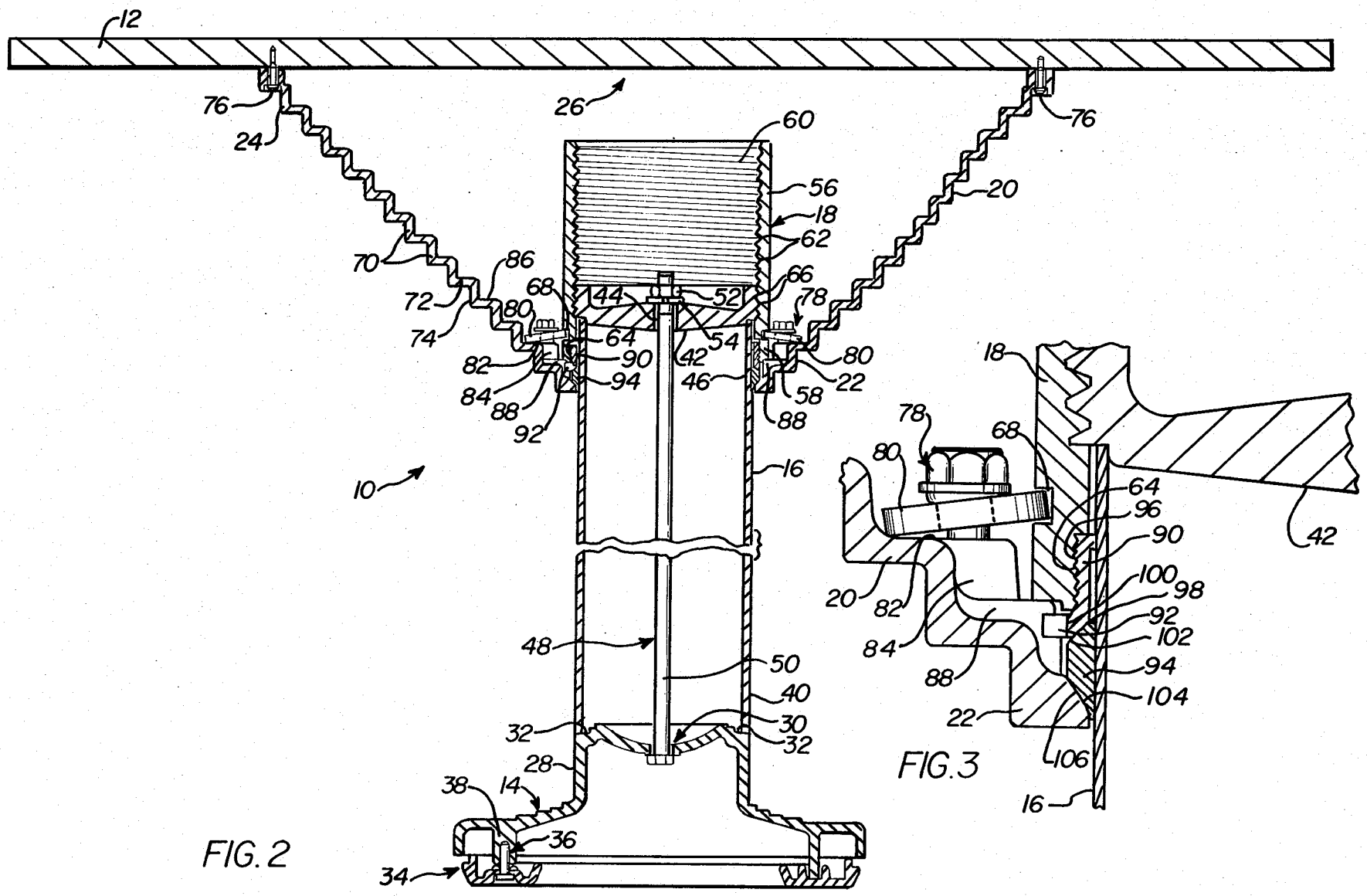
FIG. 2 is a cross-sectional view of the adjustable support taken along lines 2—2 of FIG. 1.
FIG. 3 is an enlarged portion of the sectional view in FIG. 2.

Referring to the drawings in detail, there is shown an adjustable support 10 for a tabletop 12 or other similar article. The support includes a floor-engaging base 14, a leg tube 16 rotatably mounted to the base, an adjustment tube 18 telescopically engaging and threadably connected to the leg tube, and a spider 20 securely mounted at its lower portion 22 to the adjustment tube and rigidly attached at its upper portion 24 to the underside 26 of tabletop 12. Rotation of the leg tube 16 relative to the adjustment tube 18 adjusts the height of the adjustment tube relative to the leg tube to adjust the tabletop 12 to the height desired relative to the floor.

The base 14 is of a circular configuration and has an upwardly-projecting collar 28 having a hole 30 and an L-shaped, in cross-section, flange 32 circumscribing the collar. A donut-shaped base ring 34 supports the base 14 and is rigidly secured to the same by a plurality of first pins 36 spaced evenly around the base and extending through the base ring and into a corresponding number of aligned first bosses 38 of the base.

The leg tube 16 is an elongated tubular member and slidably engages at its bottom portion 40 the base 14 on the flange 32. A threaded top cap 42 having an aperture 44 is rigidly secured to the top portion 46 of the leg tube by a tension rod 48 which is secured to and between the base 14 and the top cap 42. Specifically, in the preferred embodiment, the tension rod 48 is a bolt 50, a nut 52 and a washer 54 combination, with the bolt 50 extending through hole 30, aperture 44, and washer 54, and with the nut 52 engaging the bolt, in the conventional manner, above the top cap.

The adjustment tube 18 is a relatively short tubular member and has a thick upper wall 56 and a relatively thin lower wall 58. On the inside surface 60 of the adjustment tube 18 is a series of large threads 62 running down the majority of the length of the thick upper wall 56 and a plurality of small threads 64 running up the length of the thin lower wall 58. Threads 66 of the top cap 42 correspond in size to and engage the large threads 62 of the adjustment tube 18. In addition, the adjustment tube 18 has, circumscribing the lower outside surface thereof, a circular groove 68.

The leg tube 16 and adjustment tube 18 are connected to the tabletop 12 by a spider 20. The spider is a cone-shaped member and has on its inside periphery a series of circular steps 70 running down its length, with each step having a horizontal leg 72 and vertical leg 74. In addition, the spider 20 is rigidly secured at its upper portion 24 to the underside 26 of the tabletop 12 by a number of second pins 76 equidistantly spaced apart around the adjustable support 10 and which extend through the spider 20 and into the tabletop. The spider 20 is securely attached at its lower portion 22 to the adjustment tube 18 by a plurality of third pins 78 extending (1) through a corresponding number of openings (not shown) in an equal number of plates 80 evenly spaced around the support 10, substantially rectangular in shape, resting on the inside surface 82 of a horizontal leg 72 of the spider 20 and engaging the circular groove 68 in the adjustment tube 18 and (2) into a corresponding number of second bosses 84 formed on the inside surface 86 of the spider 20. The spider also has, on the inside surface 86 thereof, a plurality of ribs 88 equidistantly positioned around the support 10 and the function of which will be more fully discussed below.

To compensate for manufacturing tolerances of the spider 20 and the leg tube 16 and to provide for a predetermined degree of frictional resistance to rotational movement of the leg tube 16 relative to the adjustment tube 18, the adjustable support 10 includes a wedge ring 90, a key 92, and a collet 94. The wedge ring 90 circumscribes the leg tube 16; and has on its outside surface threads 96 corresponding in size to and engaging the small threads 64 of the adjustment tube and a bottom angular surface 98. The key 92 is an outwardly-projecting tab-like member integral with a bottom part 100 of the wedge ring 90 and adapted to interfere with a selected rib 88 of the spider 20. The collet 94 circumscribes the leg tube 16 below the wedge ring 90; is split so that its diameter can contract radially around the leg tube 16; and has an angular upper side 102 in flush bearing engagement with the bottom angular surface 98 of the wedge ring 90 and an angular lower side 104 engaging a corresponding angular surface 106 of the spider.

In the assembly process, the elements of the adjustable support 10 are loosely assembled with third pins 78 in untightened condition. The adjustment tube 18 is then rotated in the appropriate direction to somewhat tighten the collet 94 against the leg tube 16 through forces exerted on the collet by the wedge ring 90 and the spider 20. Specifically, rotational movement of the adjustment tube 18 causes the wedge ring 90 to rotate until the key 92 moves into a position of interference with a rib 88 of the spider 20 and thereafter causes the wedge ring to thread downwardly relative to the adjustment tube to thereby exert a downwardly directed force on the angular upper side 102 of the collet 94. Since the angular lower side 104 of the collet is in engagement with the corresponding angular surface 106 of the spider, rotational movement of the adjustment tube 18, which causes the wedge ring 90 to exert a downward force on the collet 94, in turn causes an equal and opposite force to be exerted on the collet by the spider 20. The upwardly directed and downwardly directed forces exerted on the collet 94 by the spider 20 and the wedge ring 90, respectively, require the diameter of the collet to contract radially around the leg tube 16. The foregoing assembly steps compensate for manufacturing tolerances which would normally result in excessive play between mating elements of the adjustable support and create some degree of frictional resistance to rotational movement of the leg tube relative to the adjustment tube to prevent inadvertent rotation of the leg tube after the same has been set in the desired adjusted position. It should be noted that excessive rotation of the adjustment tube during assembly would cause the collet to clamp down on the leg tube and thereafter prevent rotational movement of the leg tube and thus adjustment of the leg tube relative to the adjustment tube. Consequently, in the assembly process, the adjustment tube is rotated a predetermined degree—an amount just enough to compensate for manufacturing tolerances and to provide some degree of frictional resistance to rotation of the leg tube.

Subsequent to the foregoing assembly steps, the third pins 78 are tightened to rigidly secure the adjustment tube 18 to the spider 20 and thereafter prevent rotational movement of the adjustment tube and thus loosening of the collet 94 from the leg tube 16.

After the pins 78 have been torqued, the height of the table 12 is adjusted relative to the floor by merely rotating the leg tube 16 in the appropriate direction relative to the adjustment tube 18 until the desired table height is obtained.

In the preferred embodiment, the leg tube 16, the adjustment tube 18, the tension rod 48, the plates 80 and the base 14 are composed of metal such as steel or aluminum. It is contemplated, however, that the base could be made of a plastic material rather than a metal. Also, in the preferred embodiment, the spider is made of cast aluminum.

In addition, in the preferred embodiment, the wedge ring 90, the key 92, the collet 94 and the base ring 34 are made of a low-friction plastic material. Since the collet is in continual engagement with the leg tube, there is a desire to avoid metal-to-metal contact to prevent wear of the parts. Thus, the collet is composed of plastic or some other suitable nonmarring material. The wedge ring does not engage the leg tube; thus, although the wedge ring is preferrably composed of a plastic material, it could also be made of a metal such as aluminum. Since the key is integral with the wedge ring, it will necessarily be made of the same material as of that of the wedge ring. Since the base ring is in continual engagement with the floor, it is preferrably made of a nonmarring material and is thus composed of a plastic compound.

While the invention will be described in connection with the preferred embodiment, it will be understood that I do not intend to limit the invention to that embodiment. To the contrary, I intend to cover all alternatives, modifications and equivalents as may be included within the spirit and scope of the invention as defined by the appended claims.

The embodiments of the invention in which an exclusive property or privilege is claimed are defined as follows:

1. In an adjustable support for a tabletop, the combination of a lower tube; an upper tube threadably and rotatably connected to the lower tube and vertically adjustable with respect thereto; and a table support nonrotatably mounted to and between the upper tube and the tabletop; the improvement which comprises:

a rigidifying means for adjustably maintaining the lower tube in tight mating relationship to the table support and for providing frictional resistance to rotational movement of the lower tube relative to the upper tube; whereby the tabletop is vertically adjustable with respect to the lower tube by rotation of the lower tube with respect to the upper tube.

2. An adjustable support according to claim 1 wherein said rigidifying means comprises a wedge ring threadably connected to the upper tube; and a collet engaging at one end the wedge ring and at the other end the table support and adapted to tighten against the lower tube, through forces exerted on the collet by the wedge ring and the table support, when the upper tube is rotated.

3. An adjustable support according to claim 2 wherein the support further comprises a floor-engaging base on which is rotatably mounted the lower tube; a top cap threadably engaging the upper tube; and a rod rigidly securing the top cap to the upper tube and rotatably mounting the lower tube to the base.

4. An adjustable support according to claim 3 wherein the lower tube, upper tube, the table support, the top cap, the rod and the base are metal; and the wedge ring and the collet are made of a low-friction plastic so that the collet may slide smoothly on the lower tube when the same is rotated relative to the upper tube.

5. An adjustable support according to claim 1 wherein the support further comprises a securing means for fixing the lower tube, the upper tube and the table support in said tight, mating relationship.

6. An adjustable support according to claim 5 wherein the rigidifying means comprises a wedge ring threadably connected to the upper tube; and a collet engaging at one end the wedge ring and at the other end the table support and adapted to tighten against the lower tube, through forces exerted on the collet by the wedge ring and the table support, when the upper tube is rotated; and wherein the securing means comprises at least one plate secured to and between the upper tube and the table support to prevent rotation of the upper tube and loosening of the collet from the leg tube.

7. An adjustable support according to claim 6 wherein the support further comprises a floor-engaging base on which is rotatably mounted the lower tube; a top cap threadably engaging the upper tube; and a rod rigidly securing the top cap to the upper tube and rotatably mounting the lower tube to the base.

8. An adjustable support according to claim 7 wherein the lower tube, the upper tube, the table support, the at least one plate, the top cap, the rod and the base are metal; and the wedge ring and the collet are made of a low-friction plastic to enable the collet to slide smoothly on the lower tube upon rotation of the same with respect to the upper tube.

9. In an adjustable support for a tabletop, the combination of a lower tube; an upper tube threadably connected to the lower tube; a table support mounted to and between the upper tube and the tabletop; a securing means for non-rotatably mounting the upper tube to the table support; wherein the improvement in the securing means comprises at least one plate secured to and between the upper tube and the table support; a floor-engaging base on which the lower tube is rotatably mounted; a top cap threadably engaging the upper tube; and a rod rigidly securing the top cap to the upper tube and rotatably mounting the lower tube to the base.

10. An adjustable support according to claim 9 wherein the lower tube, the upper tube, the table support, the at least one plate, the rod and the base are composed of metal.

* * * * *